US007689160B2

(12) United States Patent
Sato

(10) Patent No.: US 7,689,160 B2
(45) Date of Patent: Mar. 30, 2010

(54) IMAGE FORMING SYSTEM

(75) Inventor: Kazuo Sato, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 230 days.

(21) Appl. No.: 11/826,307

(22) Filed: Jul. 13, 2007

(65) Prior Publication Data

US 2008/0056760 A1 Mar. 6, 2008

(30) Foreign Application Priority Data

Sep. 4, 2006 (JP) ..... 2006-238799

(51) Int. Cl.
*G03G 15/00* (2006.01)

(52) U.S. Cl. ..... 399/407; 399/107; 399/411

(58) Field of Classification Search ..... 399/107, 399/407, 411, 405

See application file for complete search history.

(56) References Cited

FOREIGN PATENT DOCUMENTS

JP 62-019354 1/1987
JP 06-286931 10/1994
JP 2002060118 A * 2/2002
JP 2006-040103 2/2006

OTHER PUBLICATIONS

Japanese Office Action dated Sep. 9, 2008.

* cited by examiner

*Primary Examiner*—David M Gray
*Assistant Examiner*—Rodney Bonnette
(74) *Attorney, Agent, or Firm*—Finnegan, Henderson, Farabow, Garrett & Dunner, L.L.P.

(57) ABSTRACT

An image forming system including an image forming apparatus for forming an image on a sheet and for ejecting the sheet, a plurality of post-processing apparatuses for receiving the ejected sheet on which an image has been formed and for applying post-processing to the sheet, and a transfer device for transferring the plurality of post-processing apparatuses relative to the image forming apparatus and for connecting one of the plurality of post-processing apparatuses to the image forming apparatus.

8 Claims, 10 Drawing Sheets

IMAGE FORMING SYSTEM

This application is based on Japanese Patent Application No. 2006-238799 filed on Sep. 4, 2006 in Japanese Patent Office, the entire content of which is hereby incorporated by reference.

BACKGROUND OF THE INVENTION

The present invention relates to an image forming system that is structured by connecting a post-processing apparatus to an image forming apparatus.

A post-processing apparatus having functions to conduct various types of post-processing is connected to a high speed image forming apparatus as in the case of an electrophotographic image forming apparatus.

In post-processing apparatuses, there is one, for example, wherein plural post-processing functions are provided in one apparatus such as a post-processing apparatus equipped with a punching function and a folding function. However, for the purpose of allowing various post-processing to be possible, it becomes difficult to make one apparatus to have many types of post-processing functions, and plural post-processing apparatuses are connected to an image forming apparatus to construct an image forming system, to realize a multifunctional image forming system.

For example, in Japanese Patent Publication Open to Public Inspection No. 2005-206264 an image forming system is disclosed, wherein three post-processing apparatuses are connected to an image forming apparatus, and book binding processing and stitching-processing including punching processing, various types of folding processing and cutting, are conducted for the sheet on which an image has been formed.

In the structure of a conventional image forming system, it is unavoidable that a sheet conveyance path of the post-processing apparatus becomes long because plural post-processing apparatuses are connected to an image forming apparatus in series, and this long conveyance path causes various points to be improved.

Main points are as follows. (1) Electric power is consumed wastefully, which is not preferable from the viewpoint of energy saving, and running cost is increased. For example, even in the case of a print job requiring no post-processing, all conveyance devices of the system are driven to eject the sheet to a sheet ejection section of the post-processing device on the rearmost part. (2) Since the conveyance path becomes long, the probability of an occurrence of conveyance troubles is enhanced, and stability and reliability of the conveyance system are declined. (3) When conveyance troubles such as jamming are caused, the system is stopped, and this stop increases the number of sheets remaining in the conveyance path, resulting in an increase of waste of sheets, and workability of jam recovery such as removal of sheets is lowered. (4) A trouble of a single apparatus makes the total system to break down, which causes the system to be fragile. (5) Because of a restriction for sheet conveyance, the number of post-processing apparatuses is limited, which limits the realization of the multifunctional image forming system.

The image forming system formed by connecting plural post-processing apparatuses to an image forming apparatus has many points to be improved as stated above, and it is considered to connect various combinations of an image forming apparatus and a post-processing apparatus to a network. In this case, an image forming apparatus is connected to each post-processing apparatus, thus, image forming apparatuses of the same number as that of post-processing apparatuses are required, resulting in problems in terms of installation space and installation cost, which makes it difficult to put the image forming system to practical use.

Further, it is extremely difficult to maintain evenly output functions between each unit of the image forming apparatuses, and the image forming system formed through network connection is insufficient for needs for high level image quality such as a field of POD (POINT ON DEMAND).

SUMMARY

An objective of the invention is to solve the aforesaid problems confronted in the case of causing an image forming system to be a multifunctional one.

The aforesaid objective is attained by the following invention.

An image forming system characterized to have an image forming apparatus, plural post-processing apparatuses each receiving a sheet ejected from the image forming apparatus after being subjected to image forming, and conducting post-processing on the received sheet and a transfer device that moves the post-processing apparatuses relative to the image forming apparatus and connects one of the aforesaid plural post-processing apparatuses to the image forming apparatus.

DETAILED DESCRIPTION OF THE PREFERRED EMBODIMENT

The present invention will be explained as follows based on the illustrated embodiment to which, however, the invention is not limited.

Figure 1:
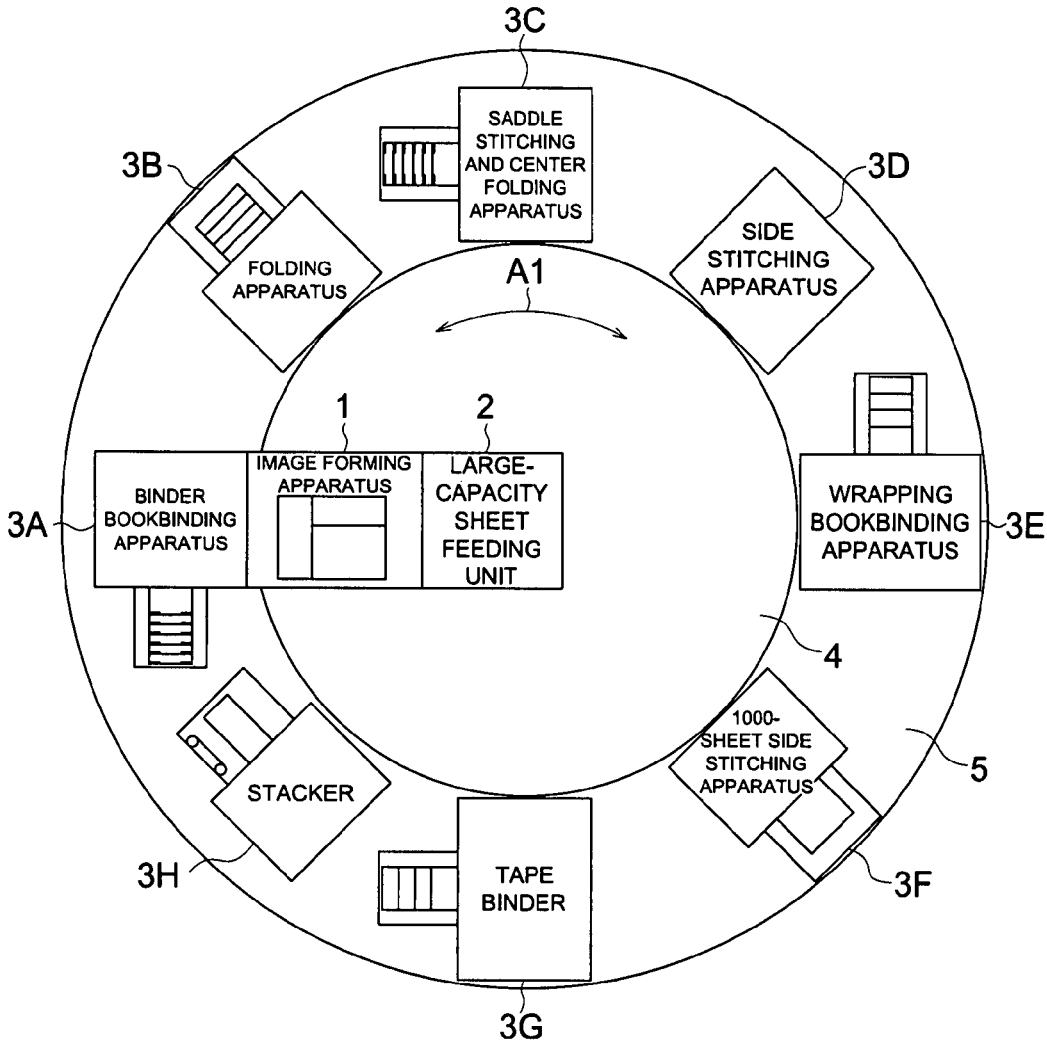
FIG. 1 is a diagram showing the total structure of an image forming system relating to an embodiment of the invention.
Figure 2:
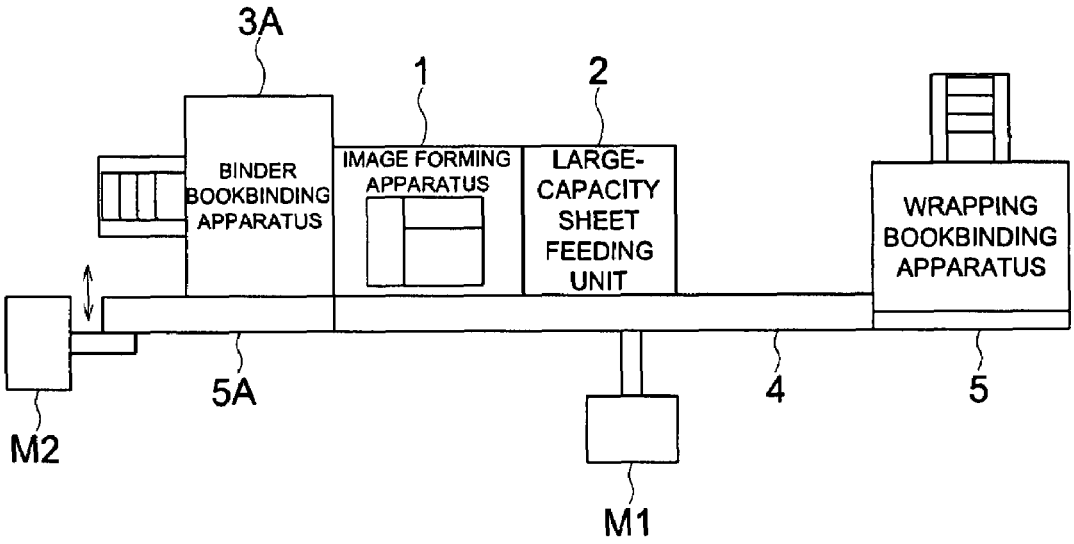
FIG. 2 is a side view of the image forming system shown in FIG. 1.

FIG. 1 is a diagram showing the total structure of an image forming system relating to an embodiment of the invention, and FIG. 2 is a side view of the image forming system shown in FIG. 1.

The image forming system has therein image forming apparatus 1, large-capacity sheet feeding unit (PFU) 2 and a plurality of post-processing apparatuses 3A-3H.

The image forming apparatus 1 is an image forming apparatus of an electrophotographic mode which has an image forming section that forms an image on a sheet through an electrophotographic process and a sheet feeding section that stores sheets and supplies a sheet to the image forming section.

The large-capacity sheet feeding unit 2 is a large-capacity sheet feeding section that supplies a sheet to the image forming section in place of a sheet feeding section provided in the image forming apparatus.

Figure 3:
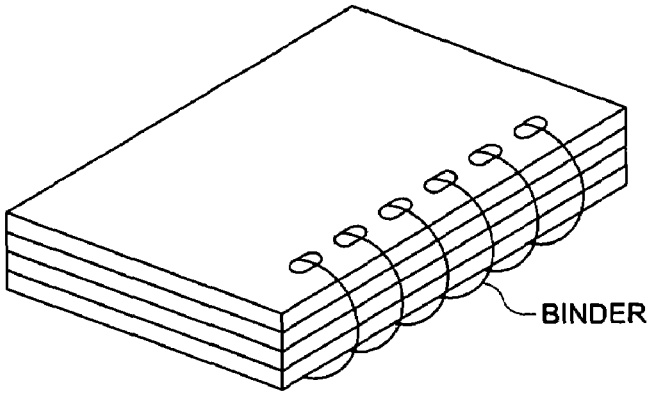
FIG. 3 is a diagram showing a bundle of sheets made by a binder bookbinding apparatus.

The post-processing apparatuses 3A-3H are processing apparatuses each having a different processing function, and post-processing apparatus 3A is a binder bookbinding apparatus which that bores plural holes along a side of the sheet to bind a book by passing a binder through the holes as shown in FIG. 3.

The post-processing apparatus 3B is a folding apparatus which is a processing device that carries out folding processing including half fold, folding in three and Z-folding for sheets in quantity of a relatively small number such as one to several sheets.

Figure 4:
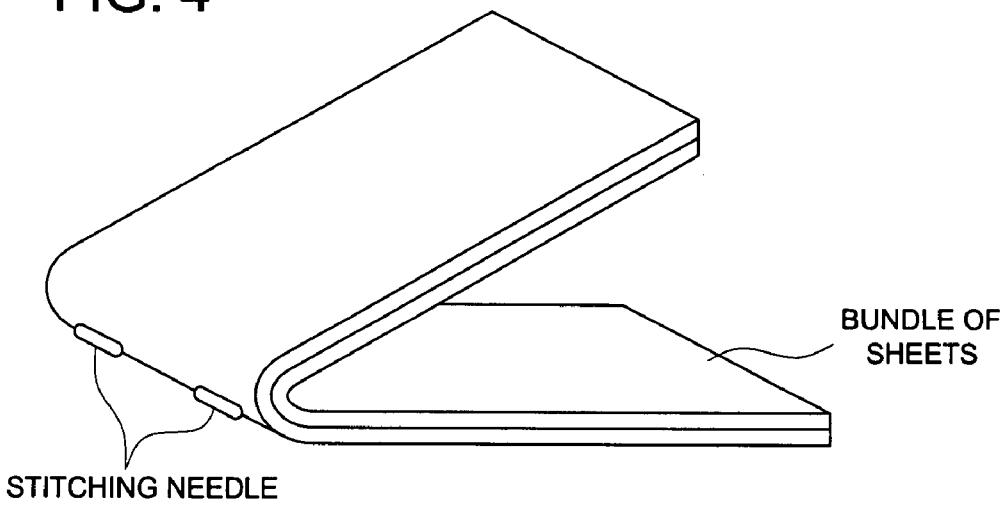
FIG. 4 is a diagram showing a bundle of sheets made by a saddle stitching and center folding apparatus.

The post-processing apparatus 3C is a saddle stitching and center folding apparatus which is a processing device that stitches with stitching needles for a center-folding line on numerous sheets to fold the sheets double along the center-folding line as shown in FIG. 4.

Figure 5:
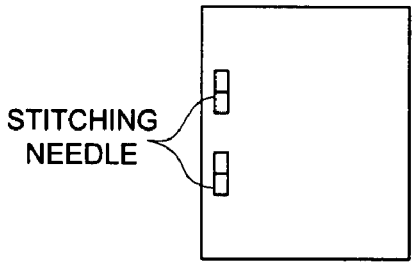
FIG. 5(*a*) and FIG. 5(*b*) are diagrams showing a bundle of sheets stitched by a side stitching apparatus.
Figure 5:
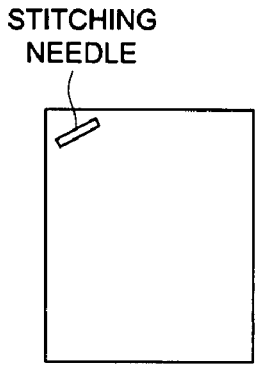

The post-processing apparatus 3D is a side stitching apparatus which is a post-processing device that stitches with stitching needles at one location or two locations along a side of the sheet as shown in FIGS. 5(*a*) and 5(*b*).

Figure 6:
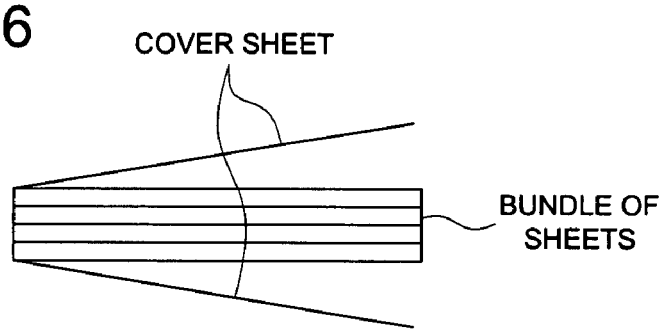
FIG. 6 is a diagram showing a bundle of sheets made by a wrapping bookbinding apparatus.

The post-processing apparatus 3E is a wrapping bookbinding apparatus which is a post-processing device that wraps a bundle of sheets each having been subjected to image forming with a cover sheet as shown in FIG. 6, and glues the bundle of sheets and the cover sheet together on a spine.

The post-processing apparatus 3F is a side stitching apparatus that conducts, for example, stitching-processing for a bundle of sheets in quantity of a large number such as 100 sheets or more.

Figure 7:
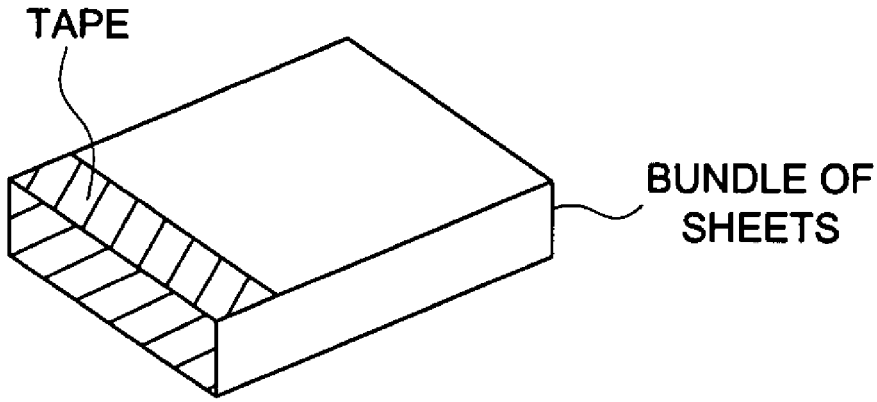
FIG. 7 is a diagram showing a bundle of sheets made by a tape binder.

The post-processing apparatus 3G is a bookbinding apparatus which is called a tape binder representing a post-processing apparatus that glues a tape on a spine of the bundle of sheets after conducting stitching-processing on a side of the sheet as shown in FIG. 7.

The post-processing apparatus 3H is a stacker on which a large number of sheets are stacked.

Each of post-processing apparatuses 3A-3H is well known on an individual basis. In the mean time, it is naturally possible that an image forming system includes a single post-processing apparatus having therein a plurality of post-processing functions.

Image forming apparatus 1 and large-capacity sheet feeding unit 2 are installed in a way that they rotate together with circular installation table 4 serving as an image forming apparatus installation section, in an integrated manner.

Post-processing apparatuses 3A-3H are installed on ring-shaped installation table 5 serving as a post-processing apparatus installation section.

Installation table 4 can rotate as shown with arrow A1, and the installation table 4 is rotated by the drive of motor M1 representing a transfer device relative to post-processing apparatuses 3A-3H, so that each of the image forming apparatus 1 and large-capacity sheet feeding unit 2 is set to the position to face one of the post-processing apparatuses 3A-3H.

Incidentally, as explained below, a sheet ejection port of image forming apparatus 1 and a sheet introduction inlet of the post-processing apparatus are required to agree with each other accurately in terms of a position, and for making both of them to agree with each other, the post-processing apparatus which requires height adjustment is installed on a floor capable of rising and lowering. In FIG. 2, post-processing apparatus 3A is installed on floor 5A capable of rising and lowering which rises or lowers through the drive of motor M2.

In each of FIG. 1 and FIG. 2, image forming apparatus 1 is installed on installation table 4 to be connected to post-processing apparatuses 3A-3H selectively when the installation table 4 is rotated. However, it is also possible to install image forming apparatus 1 to be fixed, and to install the post-processing apparatuses 3A-3H to be rotated. Further, although the image forming system is constituted with post-processing apparatuses in quantity as many as 3A-3H in FIG. 1, the number of post-processing apparatuses constituting the image forming system may also be an optional number of two or more.

Figure 8:
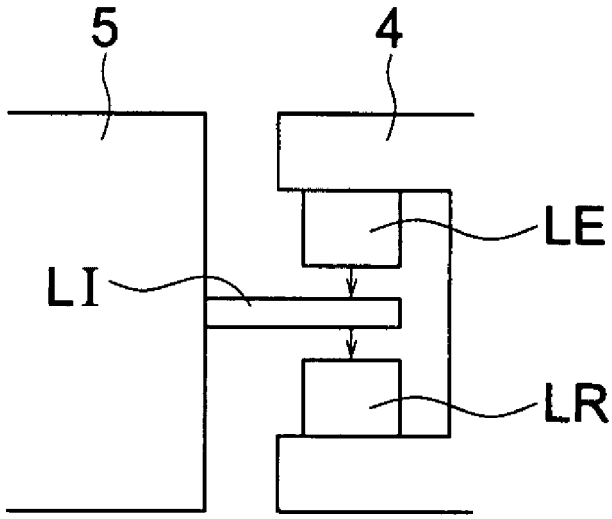
FIG. 8 is a diagram showing a positioning device that sets positional relationship between image forming apparatus 1 and post-processing apparatus 3.

FIG. 8 shows a positioning device that sets positional relationship between image forming apparatus 1 and post-processing apparatus 3.

Light emitting element LE and light receiving element LR are provided on installation table 4, and light shielding piece LI is provided on installation table 5. Each of the light emitting element LE, the light receiving element LR and the light shielding piece LI constructs a photo-interrupter representing an optical switch, and when the installation table 4 comes to a prescribed position of the installation table 5, there are conducted control procedures wherein the light shielding plate LI intercepts a light emitted from the light emitting element LE, the light receiving element LR outputs signals and the installation table 4 is stopped based on the signals of the light receiving element LR.

Figure 9:
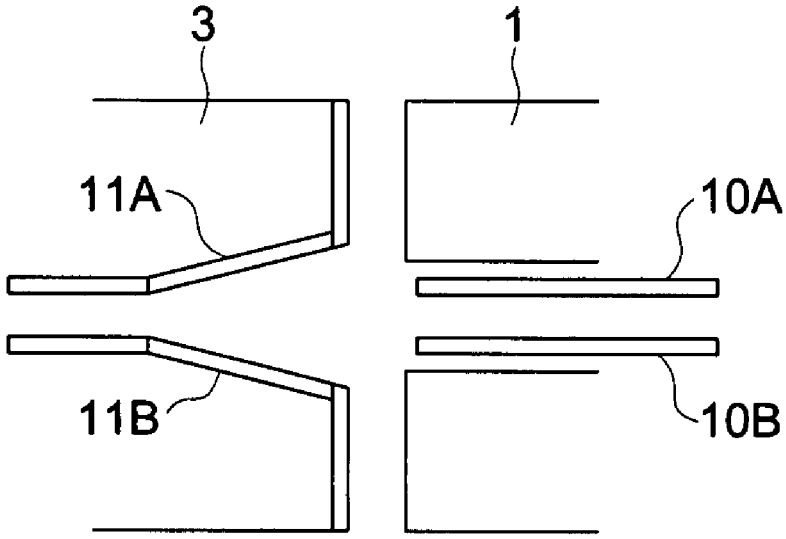
FIG. 9(*a*) and FIG. 9(*b*) show an example of the installation of a sheet delivering device.
Figure 9:
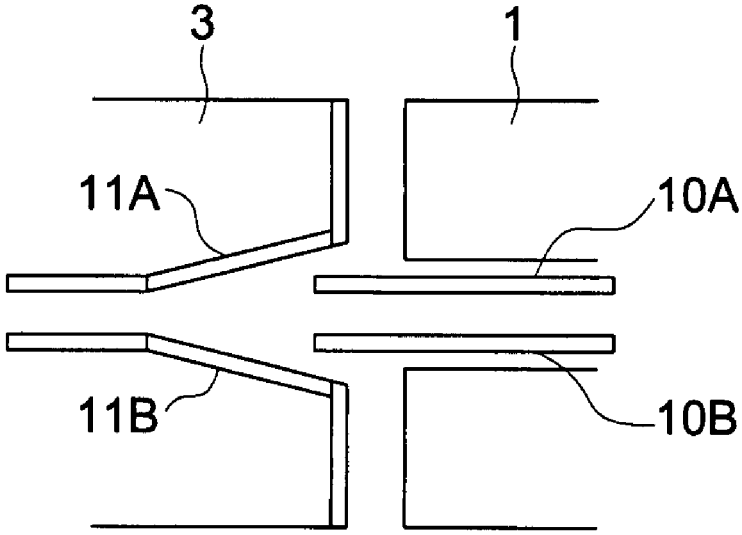

Incidentally, another positioning device such as a micro-switch can be used in place of the optical switch. Whereby, image forming apparatus 1 and post-processing apparatus 3 are coordinated accurately in terms of a position, and further there is provided a sheet delivering device that delivers a sheet to a sheet receiving inlet of the post-processing apparatus 3 smoothly from a sheet ejection port of image forming apparatus 1. FIG. 9 shows an example of a sheet delivering device.

The image forming apparatus 1 has, on its sheet ejection port, sheet ejection guide plates 10A and 10B, and the post-processing apparatus 3 has, on its sheet receiving inlet, sheet receiving guide plates 11A and 11B.

As is illustrated, the sheet ejection guide plates 10A and 10B are formed to be in parallel with each other, while, the sheet receiving guide plates 11A and 11B are formed to be in a form wherein a gap between them becomes narrower gradually from the sheet entering side.

At the stage where the image forming apparatus 1 and the post-processing apparatus 3 are coordinated, both of them are installed at the position where the sheet ejection port and the sheet receiving inlet face each other as shown in FIG. 9 (*a*). After the installation to keep the state of FIG. 9 (*a*), the sheet ejection guide plates 10A and 10B are protruded from a side wall of the image forming apparatus 1 as shown in FIG. 9 (*b*), and tips of them enter the sheet receiving inlet of the post-processing apparatus 3.

Owing to this, sheet S is delivered to the post-processing apparatus 3 from the image forming apparatus 1 smoothly and surely. Next, operations of the image forming system will be explained as follows.

Figure 10:
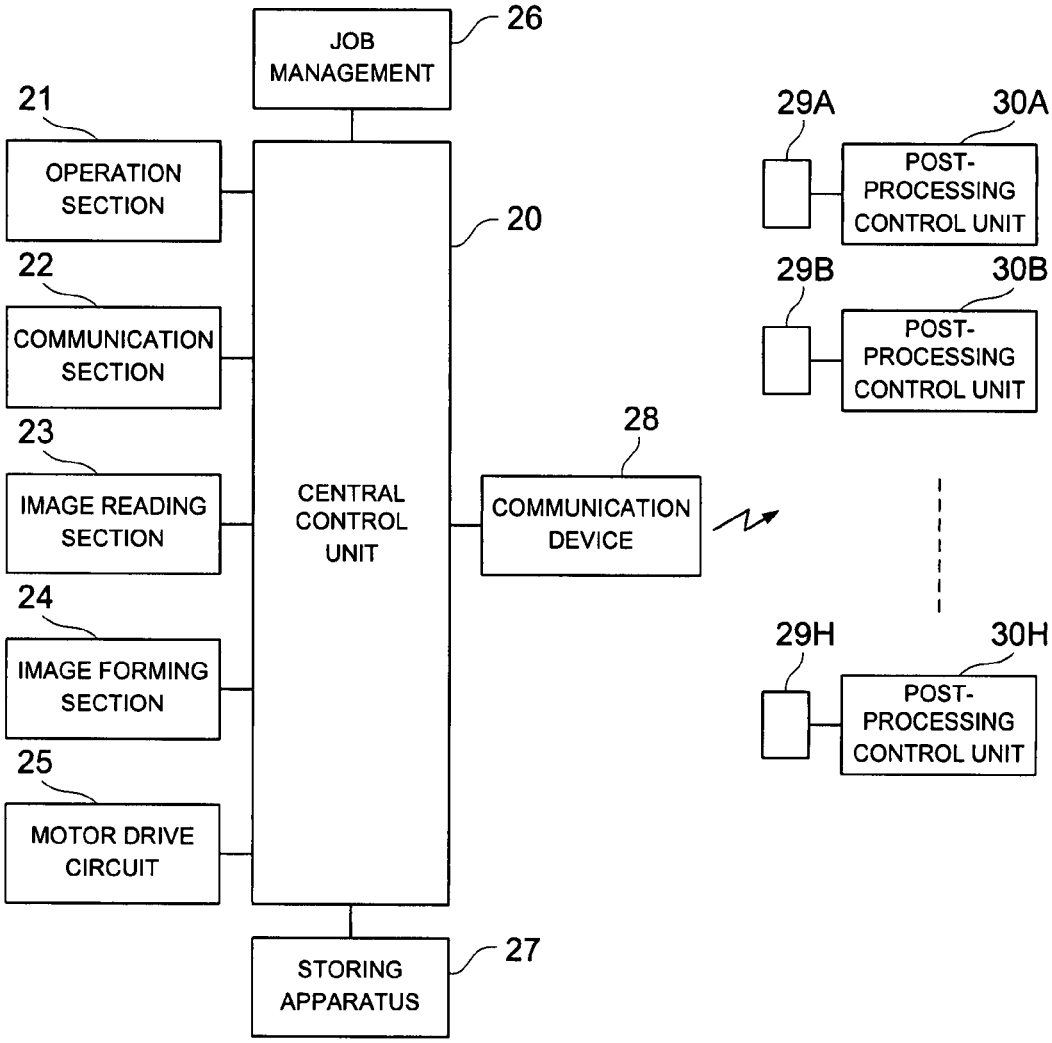
FIG. 10 is a block diagram of a control system of an image forming system relating to an embodiment of the invention.

FIG. 10 is a block diagram of a control system of an image forming system relating to an embodiment of the invention.

Central control unit 20 controls various sections of the image forming system. The numeral 21 represents an operation section provided on image forming apparatus 1 and the numeral 22 represents a communication section through which the image forming system performs communication with outer equipment.

After receiving the job instruction inputted from the operation section 21 or from the communication section 22, the central control unit 20 stores image data received from image reading section 23 or from the communication section 22, in storing apparatus 27, then, determines post-processing by referring to job management, and controls motor driving circuit 25.

The image forming apparatus 1 is connected to the designated post-processing apparatus (one of 3A-3H) through driving of motor M1 in FIG. 2.

After completion of the connection, image data are read out of the storing apparatus 27, and images are formed on a sheet through operations of image forming section 24.

The central control unit 20 is connected to post-processing control devices 30A-30H through communication device 28 of the image forming apparatus and through communication devices 29A-29H of post-processing apparatuses 3A-3H, and connection between these communication devices is formed selectively by the movement of the image forming apparatus 1, and post-processing control devices 30A-30H are controlled selectively by the central control unit 20. The communication device 28 and the communication devices 29A-29H are those to conduct communication by wireless communication employing a light or a high-frequency electromagnetic waves, and selective connection between the central control unit 20 and the post-processing control devices 30A-30H are carried out stably by the wireless communication.

Figure 11:
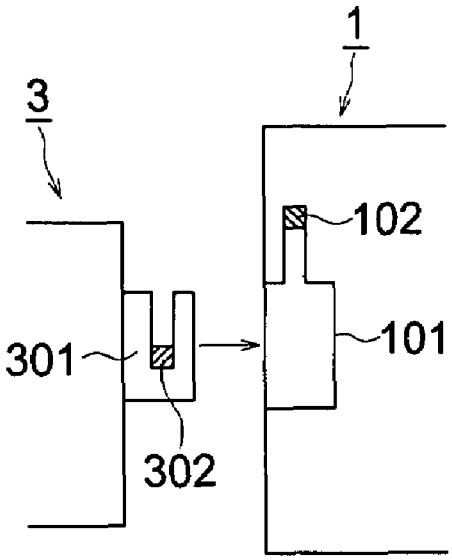
FIG. 11(*a*) and FIG. 11(*b*) are diagrams showing a connection section of a communication device.
Figure 11:
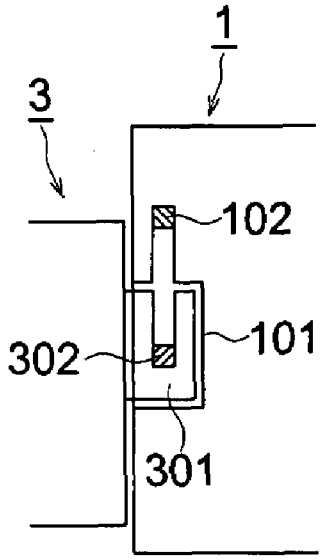

FIGS. 11(*a*) and 11(*b*) show a connection section of a communication device.

FIG. 11 (*a*) shows a state of disconnection between the image forming apparatus 1 and the post-processing apparatus 3, while, FIG. 11 (*b*) shows the state where the post-processing apparatus 3 is connected to the image forming apparatus 1.

Input terminal 302 of an optical fiber (a terminal of a wireless communication device) is incorporated in the inside of projecting portion 301 provided on post-processing apparatus 3, and output terminal 102 of an optical fiber (a terminal of a wireless communication device) is incorporated in the inside of recess portion 101 provided on the image forming apparatus 1.

As shown in FIG. 11 (*b*), when the post-processing apparatus 3 is connected to the image forming apparatus 1, the projecting portion 301 enters the recess portion 101 and the output terminal 102 and the input terminal 302 are set to the positions to face each other.

Selections from these plural post-processing apparatuses and operations of print job will be explained in detail, referring to FIG. 12 and FIG. 13.

Figure 12:
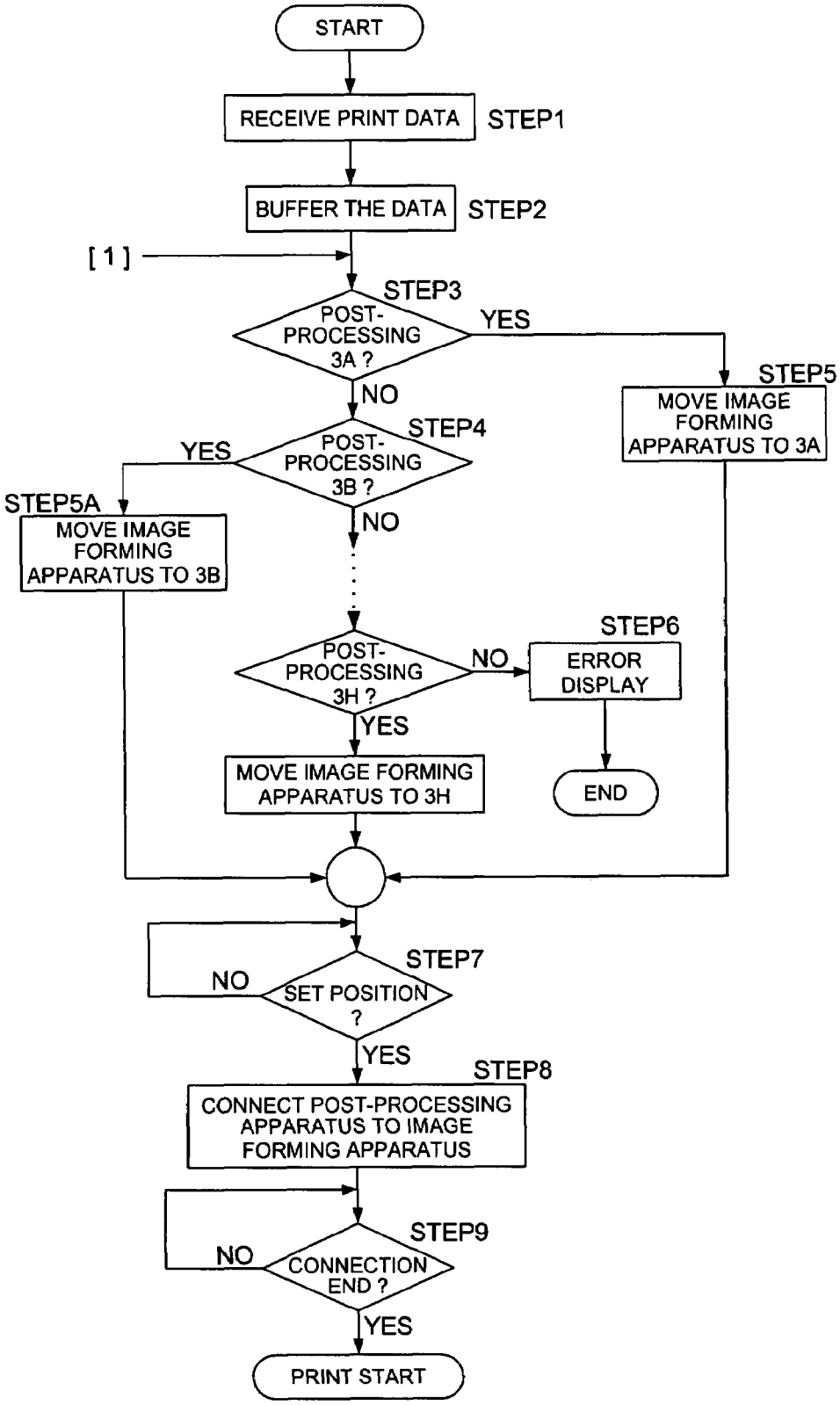
FIG. 12 is a flow chart for a preparation step to enter a print job.
Figure 13:
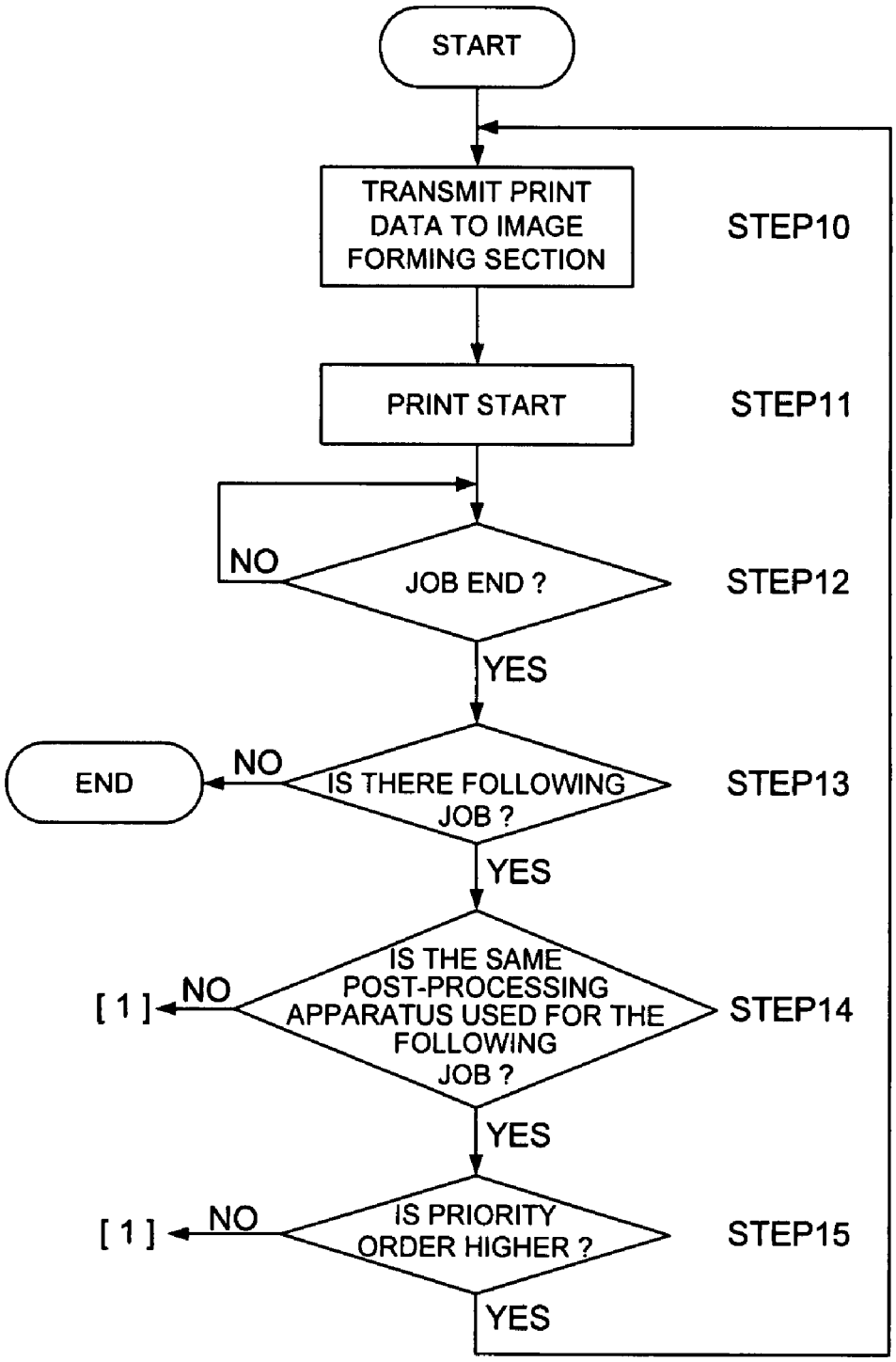
FIG. 13 is a flow chart of a print job step.

FIG. 12 is a flow chart for a preparation step to enter a print job, and FIG. 13 is a flow chart of a print job operation step.

In STEP 1 in FIG. 12, an instruction for printing is received.

The instruction for printing is an instruction by setting in operation section 21 or an instruction from an outer equipment received through communication section 22, and information that instructs contents of printing including post-processing and print data are contained in the instruction for printing.

In STEP 2, print data are stored in storing apparatus 27.

In STEP 3, it is judged whether post-processing apparatus 3A is used or not, and when the post-processing apparatus 3A is used (Y of STEP 3), image forming apparatus 1 is moved to the position of the post-processing apparatus 3A in STEP 5.

When the post-processing apparatus 3A is not used (N of STEP 3), it is judged whether post-processing apparatus 3B is used or not, in STEP 4. When the post-processing apparatus 3B is used in STEP 4, image forming apparatus 1 is moved to the position of the post-processing apparatus 3B in STEP 5A.

In the same way as in the foregoing, post-processing apparatuses up to the post-processing apparatus 3H are judged whether they are used or not, and when either one of the post-processing apparatuses 3C-3H is used, the image forming apparatus 1 is moved to the position of the post-processing apparatus to be used, while, when none of the post-processing apparatuses 3A-3H is used, error display is conducted (STEP 6) to terminate.

The image forming apparatus 1 is moved to the position of the selected post-processing apparatus, and in STEP 7, the position of the image forming apparatus is set accurately by the aforesaid positioning device, and in STEP 8, procedures to connect the selected post-processing apparatus to the image forming apparatus 1 are carried out.

In STEP 9, completion of the connection is confirmed to terminate.

Following the preparation step in FIG. 12, a printing step in FIG. 13 is practiced.

In STEP 10 in FIG. 13, print data are transmitted to image forming section 24, and printing is started in STEP 11.

In STEP 12, completion of a job is watched. The completion of the job is confirmed by receiving image forming completion signals in the image forming section 24, and post-processing completion signals in the post-processing apparatus.

In STEP 13, whether a following job exists or not is checked, and when a following job is not in existence, then the job is terminated, while, when a following job is in existence, whether or not the following job employs the same post-processing apparatus as that for the preceding job is checked in STEP 14.

When the same post-processing apparatus is not used, the flow moves to [1] of FIG. 12 to practice the step of selection for the post-processing apparatuses on and after STEP 3.

When following jobs include one that uses the same post-processing as that for the preceding job (Y of STEP 14), the priority order of the job is checked (STEP 15). The priority order is included in the image forming instruction.

When the priority order is low (N of STEP 15) compared with jobs waiting before the following job, the flow moves to [1] of FIG. 12 to practice the step of selection for the post-processing apparatuses as in the foregoing, while, when the priority order is high (Y of STEP 15), the flow moves to STEP 10 to enter the printing step that employs the post-processing apparatus used in the preceding job.

Figure 14:
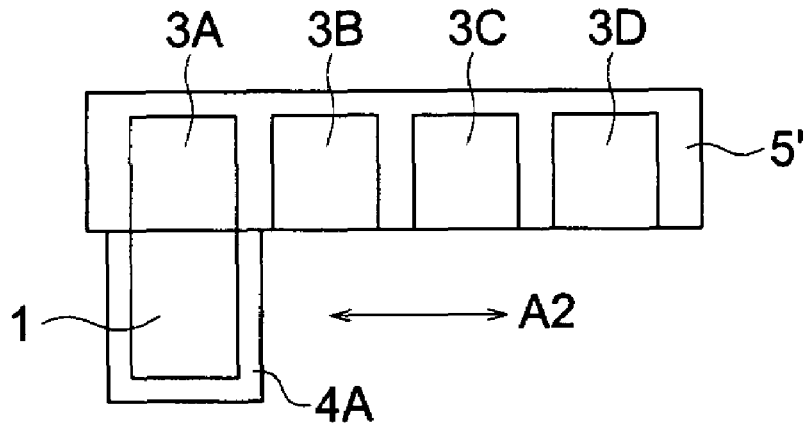
FIG. 14 is a diagram showing another example of an image forming system relating to an embodiment of the invention.
Figure 15:
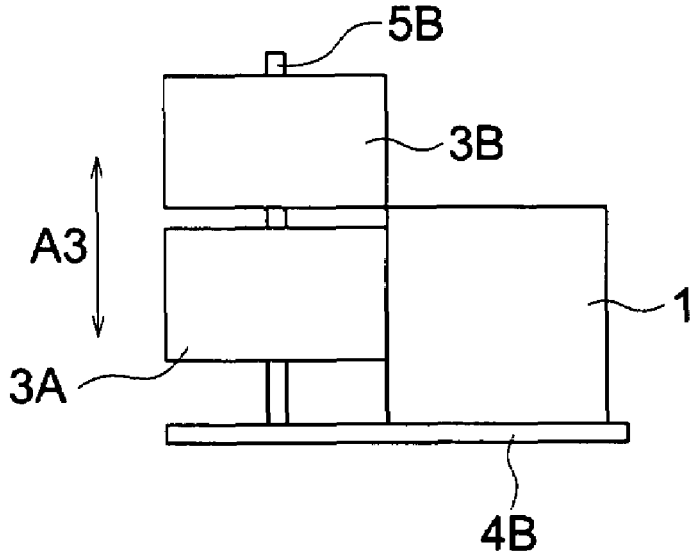
FIG. 15 is a diagram showing still another example of an image forming system relating to an embodiment of the invention.

Each of FIG. 14 and FIG. 15 shows another example of the image forming system relating to the embodiment of the invention.

FIG. 14 shows an example wherein plural post-processing apparatuses 3A-3D are linearly-arranged, and image forming apparatus 1 is supported by moving installation table 4A representing a section to install an image forming apparatus that moves along the straight line, to move linearly as shown with arrow A2 to be connected selectively to the post-processing apparatuses 3A-3D supported by fixed installation table 5'.

FIG. 15 shows an example wherein post-processing apparatuses 3A and 3B are arranged vertically, and the post-processing apparatuses 3A and 3B rise or lower in the direction of arrow A3 to be connected selectively with image forming apparatus 1. The image forming apparatus 1 is supported by installation table 4B representing a section to install an image forming apparatus, and is supported and guided by columnar support 5B representing a section to install a post-processing apparatus, whereby, the post-processing apparatuses 3A and 3B are connected selectively to the image forming apparatus 1. The columnar support 5B is fixed on the installation table 4B.

The invention makes it possible to compose a multifunctional image forming system without lengthening a conveyance path for a sheet, because a single post-processing apparatus is selected from a plurality of post-processing apparatuses to be connected to an image forming apparatus. In addition, problems described below are solved. (1) Electric power is consumed wastefully, which is not desirable from the viewpoint of energy saving, and causes an increase of running cost. In the extreme example, for ejecting a sheet to a sheet ejection section of a post-processing apparatus located at the rearmost position, all conveyance devices of the system are driven, even when a print requires no post-processing. (2) A long conveyance path causes high probability of occurrence of conveyance troubles in the course of conveyance, and stability and reliability of a conveyance system are lowered. (3) When a conveyance trouble such as a jam is caused, the apparatus is suspended, and this suspension of the apparatus increases the number of sheets staying in the conveyance path, resulting in much waste of sheets and a decline of workability for jam recovery such as removal of sheets. (4) Breakdown of a single apparatus causes breakdown of the total system, which makes the system to be fragile against breakdown. (5) The number of post-processing apparatuses to be connected is limited by the restriction for sheet conveyance, and it is limited to make the image forming system to be multifunctional.

What is claimed is:

1. An image forming system comprising:

an image forming apparatus for forming an image on a sheet to be ejected;

a plurality of post-processing apparatuses for receiving the sheet on which an image has been formed and which has been ejected from the image forming apparatus, and for applying post-processing to the sheet;

a transfer device which has a driving device for transferring at least one of the plurality of post-processing apparatuses and the image forming apparatus relative to each other; and a central control unit for controlling the driving device to allow one of the plurality of post-processing apparatuses and the image forming apparatus to face each other according to a type of post-processing to be conducted which has been decided based on a job instruction of the image forming apparatus.

2. The image forming system of claim 1, further comprising:

an image forming apparatus installation section on which the image forming apparatus is installed; and one or more post-processing apparatus installation sections on which the plurality of post-processing apparatuses are installed, wherein the transfer device changes a positional relationship between at least one of the one or more post-processing apparatus installation sections and the image forming apparatus installation section by driving of the driving device.

3. The image forming system of claim 1, wherein the central control unit is installed in the image forming apparatus.

4. The image forming system of claim 1, further comprising:

a connection device for communication connection between the image forming apparatus and at least one of the plurality of post processing apparatuses, the connecting device allowing relative movement between the image forming apparatus and the at least one of the plurality of post-processing apparatuses.

5. The image forming system of claim 4, wherein each of a connecting device of the image forming apparatus and a connecting device of one of the plurality of post-processing apparatuses is constituted of a wireless communication device.

6. The image forming system of claim 1, further comprising:

a positioning device for detecting positional relationship between the image forming apparatus and at least one of the plurality of post-processing apparatuses, wherein the central control unit controls stopping for driving of the driving device based on a detection signal from the positioning device.

7. The image forming system of claim 1, wherein the image forming apparatus has a sheet ejection guide plate constituting a sheet ejection port which ejects the sheet on which an image has been formed, and each of the plurality of post-processing apparatuses has a sheet receiving guide plate constituting a sheet receiving inlet which receives the sheet ejected from the sheet ejection port, and wherein the image forming system comprises a sheet delivering device which protrudes the sheet ejection guide plate from a side wall of the image forming apparatus, while the sheet ejection port and the sheet receiving inlet are facing each other, after changing a positional relationship between at least one of the plurality of post-processing apparatuses and the image forming apparatus.

8. The image forming system of claim 7, wherein the sheet receiving guide plate is composed of two plates and the two plates are formed such that a gap between the tow plates becomes narrower gradually from a sheet entering side.

* * * * *